US012624469B2

(12) United States Patent
Park et al.

(10) Patent No.: US 12,624,469 B2
(45) Date of Patent: May 12, 2026

(54) ELECTRODE FOR ELECTROLYSIS

(71) Applicant: LG Chem, Ltd., Seoul (KR)

(72) Inventors: Yoon Bin Park, Daejeon (KR); In Sung Hwang, Daejeon (KR); Hun Min Park, Daejeon (KR); Dong Chul Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 617 days.

(21) Appl. No.: 18/006,306

(22) PCT Filed: Nov. 8, 2021

(86) PCT No.: PCT/KR2021/016154
§ 371 (c)(1),
(2) Date: Jan. 20, 2023

(87) PCT Pub. No.: WO2022/103102
PCT Pub. Date: May 19, 2022

(65) Prior Publication Data

US 2023/0295819 A1 Sep. 21, 2023

(30) Foreign Application Priority Data

Nov. 12, 2020 (KR) ..... 10-2020-0151310

(51) Int. Cl.
*C25B 11/097* (2021.01)
*C25B 11/053* (2021.01)
(Continued)

(52) U.S. Cl.
CPC ..... *C25B 11/097* (2021.01); *C25B 11/053* (2021.01); *C25B 11/063* (2021.01); *C25B 1/34* (2013.01)

(58) Field of Classification Search
None
See application file for complete search history.

(56) References Cited

U.S. PATENT DOCUMENTS 3,875,043 A * 4/1975 Franks ..... C25B 11/093 204/290.13
4,471,006 A * 9/1984 Asano ..... C25B 11/091 427/126.3
(Continued)

FOREIGN PATENT DOCUMENTS

JP H08176876 A 7/1996
JP 2012508326 A 4/2012
(Continued)

OTHER PUBLICATIONS

Extended European Search Report including Written Opinion for Application No. 21892270.6 dated Sep. 9, 2024, pp. 1-9.
(Continued)

*Primary Examiner* — Alexander W Keeling
(74) *Attorney, Agent, or Firm* — Lerner David LLP

(57) ABSTRACT

An electrode for electrolysis and a method for manufacturing the same, wherein an electrode coating layer for electrolysis is provided in plurality, and the tin content in each coating layer is configured to increase as the distance from a substrate increases, and the titanium content therein is configured to decrease as the distance from the substrate increases, so that excellent performance is maintained, and also delamination and the like does not occur during firing, so that excellent durability may be implemented.

15 Claims, 3 Drawing Sheets

(51) Int. Cl.
*C25B 11/063* (2021.01)
*C25B 1/34* (2006.01)

(56) References Cited

U.S. PATENT DOCUMENTS

| | | | | |
|---|---|---|---|---|
| 4,481,097 | A | 11/1984 | Asano et al. | |
| 5,679,225 | A | 10/1997 | Pastacaldi et al. | |
| 7,815,781 | B2 | 10/2010 | Mojana et al. | |
| 10,415,146 | B2 | 9/2019 | Ivanter et al. | |
| 11,634,827 | B2 * | 4/2023 | Urgeghe | C25B 11/093 204/290.1 |
| 2005/0211553 | A1 | 9/2005 | Mojana et al. | |
| 2010/0024925 | A1 | 2/2010 | Warnecke et al. | |
| 2011/0209992 | A1 | 9/2011 | Urgeghe et al. | |
| 2012/0085571 | A1 | 4/2012 | Niksa et al. | |
| 2013/0186750 | A1 | 7/2013 | Urgeghe et al. | |
| 2017/0356095 | A1 | 12/2017 | Ivanter et al. | |
| 2021/0238757 | A1 | 8/2021 | Gargiulo et al. | |
| 2021/0404076 | A1 | 12/2021 | Gargiulo et al. | |

FOREIGN PATENT DOCUMENTS

| | | | |
|---|---|---|---|
| JP | 2012188716 | A | 10/2012 |
| JP | 2013543933 | A | 12/2013 |
| KR | 900006632 | B1 | 9/1990 |
| KR | 20050090700 | A | 9/2005 |
| KR | 20090007597 | A | 1/2009 |
| KR | 20120036779 | A | 4/2012 |
| KR | 20140009211 | A | 1/2014 |
| KR | 101645198 | B1 | 8/2016 |
| KR | 20160133936 | A | 11/2016 |
| KR | 20170093039 | A | 8/2017 |
| WO | 2010055065 | A1 | 5/2010 |
| WO | 2012069653 | A1 | 5/2012 |
| WO | 2019243163 | A1 | 12/2019 |
| WO | 2020115028 | A1 | 6/2020 |

OTHER PUBLICATIONS

International Search Report for PCT/KR2021/016154 mailed Feb. 17, 2022. 5 pgs.

* cited by examiner

ELECTRODE FOR ELECTROLYSIS

CROSS-REFERENCE TO RELATED APPLICATIONS

The present application is a national phase entry under 35 U.S.C. § 371 of International Application No. PCT/KR2021/016154, filed on Nov. 8, 2021, which claims the benefit of Korean Patent Application No. 10-2020-0151310, filed on Nov. 12, 2020, the disclosures of which are incorporated herein in their entirety by reference.

TECHNICAL FIELD

The present invention relates to an electrode for electrolysis capable of suppressing delamination of a coating layer thanks to excellent physical stability of the coating layer while exhibiting excellent performance, and a method for manufacturing the electrode.

BACKGROUND ART

A technology of producing hydroxides, hydrogen, and chlorine by electrolyzing low-cost brine such as seawater is widely known. Such an electrolysis process is also commonly referred to as a chlor-alkali process, the performance and reliability of which have been proven through decades of commercial operation.

As a method for electrolyzing brine, an ion exchange membrane method is currently most widely used, in which an ion exchange membrane is installed inside an electrolyzer to divide the electrolyzer into a cation chamber and an anion chamber, and brine is used as an electrolyte to obtain chlorine gas from an anode and hydrogen and caustic soda from a cathode.

Meanwhile, the electrolysis process of brine is achieved through a reaction as shown in the following electrochemical reaction equation.

$$2Cl^- \rightarrow Cl_2 + 2e^- \ (E^0 = +1.36\ V) \qquad \text{Reaction in anode}$$

$$2H_2O + 2e^- \rightarrow 2OH^- + H_2 \ (E^0 = -0.83\ V) \qquad \text{Reaction in cathode}$$

$$2Cl^- + 2H_2O \rightarrow 2OH^- + Cl_2 + H_2 \ (E^0 = -2.19\ V) \qquad \text{Entire reaction}$$

Between the two electrodes in which the electrolysis of brine is performed, as the anode, a precious metal-based electrode referred to as a dimensionally stable anode (DSA) has been developed and used, and particularly, various anodes capable of operating an electrolysis process even with a low voltage are being developed by employing a platinum group metal such as ruthenium, iridium, palladium, and platinum as a coating layer component. In addition, research is being actively conducted to improve various properties of an anode, such as current efficiency, by additionally including various components in a coating layer, other than a platinum group metal.

As an example of the research, it is known that when a tin component is included in a coating layer in addition to a platinum group metal, it is possible to increase anode performance, and improve current efficiency and selectivity. However, the tin component has a low thermal expansion coefficient compared to other metal elements, and thus, may cause cracking and delamination in the coating layer during a high-temperature firing process. Therefore, if it is possible to suppress the above-described limitation of a tin component while including a platinum group metal and a tin component together in a coating layer, it is possible to provide an anode for electrolysis excellent in terms of durability and performance.

DISCLOSURE OF THE INVENTION

Technical Problem

The present disclosure provides an electrode for electrolysis which exhibits excellent performance, but does not exhibit durability deterioration such as cracking or delamination by allowing a tin component together with a platinum group metal to be included in a coating layer, while properly controlling the distribution of the tin component in the coating layer.

Technical Solution

According to an aspect of the present technology, there are provided an electrode for electrolysis and a method for manufacturing the electrode for electrolysis.

(1) The present technology provides an electrode for electrolysis including a metal substrate layer, and a first coating layer to an N-th coating layer, wherein the first coating layer is formed on at least one surface of the metal substrate layer, and the first coating layer to the N-th coating layer are formed sequentially stacked, and Equations 1 and 2 below are satisfied:

$$CS_{n-1} < CS_n \qquad \text{[Equation 1]}$$

$$CT_{n-1} < CT_n \qquad \text{[Equation 2]}$$

In the Equations, $CS_n$ is the Sn content (mol %) in an n-th coating layer, $CT_n$ is the Ti content (mol %) in an n-th coating layer, n is an integer of 2 to N, and N is an integer of 2 or greater.

(2) In (1) above, the present technology provides an electrode for electrolysis characterized in that Equation 3 is further satisfied:

$$CS_{n-1} + CT_{n-1} = CS_n + CT_n \qquad \text{[Equation 3]}$$

In the Equations, n is an integer of 2 to N, and N is an integer of 2 or greater.

(3) In (1) or (2) above, the present technology provides an electrode for electrolysis characterized in that Equation 1 is Equation 1-2 below:

$$1 < CS_n / CS_{n-1} \leq 2 \qquad \text{[Equation 1-2]}$$

(4) In any one of (1) to (3) above, the present technology provides an electrode for electrolysis characterized in that Equation 2 above is Equation 2-2 below:

$$0.5 \leq CT_n / CT_{n-1} < 1 \qquad \text{[Equation 2-2]}$$

(5) In any one of (1) to (4) above, the present technology provides an electrode for electrolysis characterized in that $CS_1 + CT_1$ is 30 mol % to 60 mol %.

(6) In any one of (1) to (5) above, the present technology provides an electrode for electrolysis characterized in that the first coating layer to the N-th coating layer include one or more platinum group metals selected from the group consisting of ruthenium, rhodium, palladium, osmium, iridium, and platinum.

(7) In any one of (1) to (6) above, the present technology provides an electrode for electrolysis characterized in that the content of a platinum group metal in the first coating layer to the N-th coating layer is constant.

(8) In any one of (1) to (7) above, the present technology provides an electrode for electrolysis characterized in that the first coating layer to the N-th coating layer include ruthenium, iridium, and platinum.

(9) In any one of (1) to (8) above, the present technology provides an electrode for electrolysis characterized in that the total content of ruthenium in the first coating layer to the N-th coating layer is 20 $g/m^2$ or greater.

(10) In any one of (1) to (9) above, the present technology provides an electrode for electrolysis characterized in that the N is an integer of 4 to 10.

(11) In any one of (1) to (10) above, the present technology provides an electrode for electrolysis characterized in that the metal substrate layer includes one or more selected from the group consisting of nickel, titanium, tantalum, aluminum, hafnium, zirconium, molybdenum, tungsten, and stainless steel.

(12) The present technology provides a method for manufacturing an electrode for electrolysis, the method characterized by including applying and firing a first coating composition on at least one surface of a metal substrate to form a first coating layer, and sequentially applying and firing a second coating composition to an N-th coating composition on the formed first coating layer to form a second coating layer to an N-th coating layer, wherein Equations 4 and 5 below are satisfied:

$$CS'_{n-1}<CS'_n \quad \text{[Equation 4]}$$

$$CT'_{n-1}>CT'_n \quad \text{[Equation 5]}$$

In the Equations, $CS'_n$ is the Sn content (mol %) in an n-th coating composition, $CT'_n$ is the Ti content (mol %) in an n-th coating composition, n is an integer of 2 to N, and N is an integer of 2 or greater.

(13) In (12) above, the present technology provides a method for manufacturing an electrode for electrolysis, the method characterized in that the first coating composition to the N-th coating composition include one or more platinum group metals selected from the group consisting of ruthenium, rhodium, palladium, osmium, iridium, and platinum.

(14) In (12) or (13) above, the present technology provides a method for manufacturing an electrode for electrolysis, the method characterized in that the firing is performed for 1 hour or less at a temperature of 400° C. to 600° C.

(15) In any one of (12) to (14) above, the present technology provides a method for manufacturing an electrode for electrolysis, the method characterized in that a solvent of the first coating composition to the N-th coating composition includes one or more selected from the group consisting of butanol, isopropyl alcohol, and butoxyethanol.

Advantageous Effects

In an electrode for electrolysis of the present disclosure, a tin component has the lowest content in a first coating layer adjacent to a metal substrate layer, but the content thereof increases as the distance from the metal substrate layer increases, and as oppose to the tin component, a titanium component has the highest content in the first coating layer adjacent to the metal substrate layer, but the content thereof decreases as the distance from the metal substrate layer increases, so that it is possible to achieve an effect of improving performance by the tin component, and also, suppress delamination between the metal substrate layer and a coating layer.

MODE FOR CARRYING OUT THE INVENTION

Figure 1:
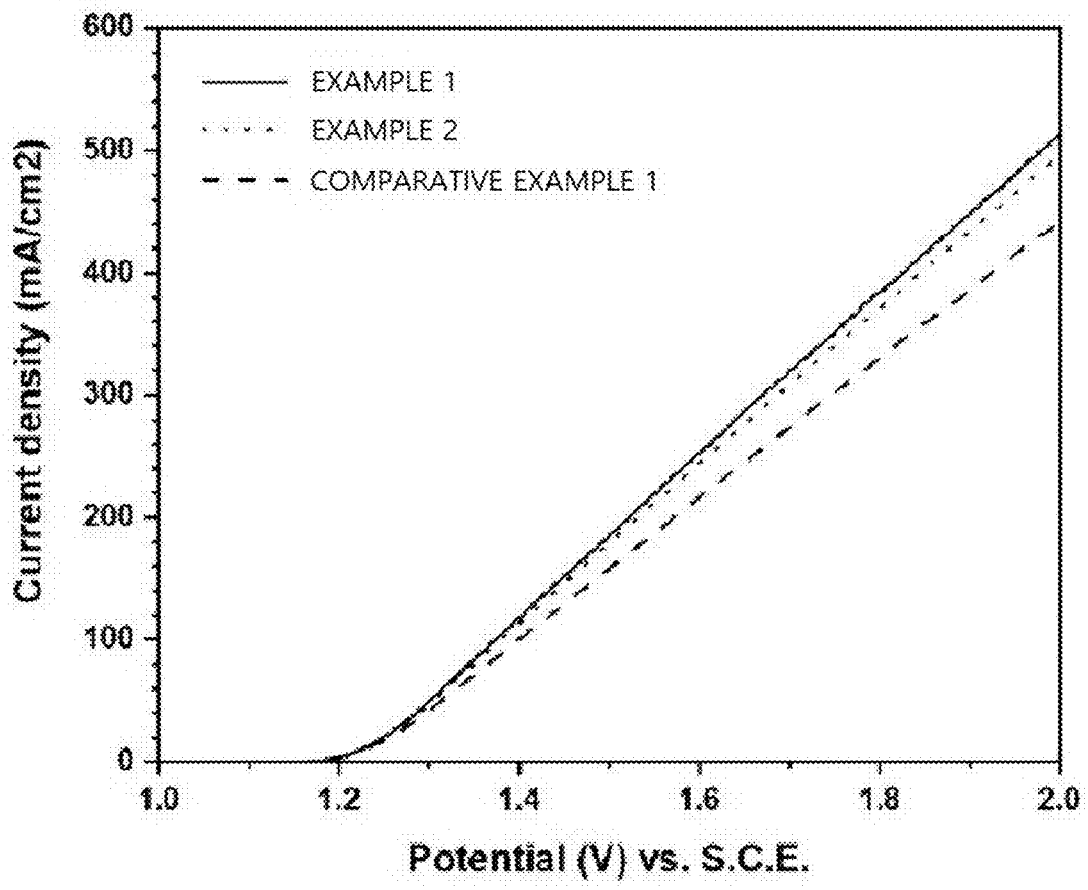
FIG. 1 is a view showing results of the performance evaluation of electrodes for electrolysis manufactured in Example 1, Example 2, and Comparative Example 1, using linear sweep voltammetry.

Hereinafter, the present invention will be described in more detail.

It will be understood that words or terms used in the specification and claims of the present invention shall not be construed as being limited to having the meaning defined in commonly used dictionaries. It will be further understood that the words or terms should be interpreted as having meanings that are consistent with their meanings in the context of the relevant art and the technical idea of the invention, based on the principle that an inventor may properly define the meaning of the words or terms to best explain the invention.

Electrode for Electrolysis

The present disclosure provides an electrode for electrolysis including a metal substrate layer, and a first coating layer to an N-th coating layer, wherein the first coating layer is formed on at least one surface of the metal substrate layer, and the first coating layer to the N coating layer are formed sequentially stacked, and Equations 1 and 2 below are satisfied:

$$CS_{n-1}<CS_n \quad \text{[Equation 1]}$$

$$CT_{n-1}>CT_n \quad \text{[Equation 2]}$$

In the Equations, $CS_n$ is the Sn content (mol %) in an n-th coating layer, $CT_n$ is the Ti content (mol %) in an n-th coating layer, n is an integer of 2 to N, and N is an integer of 2 or greater.

Typically, it is known that current efficiency and selectivity may be improved when a tin component, specifically a tin oxide, is included in a coating layer of an electrode for electrolysis, but there is a problem in that due to a relatively low thermal expansion coefficient of the tin oxide, other metal components, a substrate layer component, and the tin oxide in the coating layer are expanded to different degrees during a firing process, resulting in the delamination of the coating layer.

As a result of conducting research to address the issue, the inventor of the present invention has confirmed that when a plurality of layers are stacked and applied as a coating layer, and if the content of a tin component and the content of a titanium component in each stacked layer are properly controlled to allow a thermal expansion coefficient to be highest in a layer of the coating layer, which is adjacent to a metal substrate layer, and to allow the thermal expansion coefficient to decrease as the distance from the metal substrate layer increases, it is possible to suppress the problem of delamination of a coating layer, while enjoying the same benefits as improving current efficiency and improving performance by the tin component in the coating layer.

Hereinafter, components constituting the electrode for electrolysis of the present invention will be described separately.

Metal Substrate Layer

In the electrode for electrolysis provided by the present technology, a metal substrate layer provides a region in which a coating layer to be described later may be physically supported, and at the same time, serves to allow electrons generated or consumed during an electrolysis reaction performed on the surface of the coating layer to move to an opposite electrode or from the opposite electrode.

Therefore, the metal substrate layer is required to have a certain degree or more of strength and electrical conductivity, and may include, specifically, one or more selected from the group consisting of nickel, titanium, tantalum, aluminum, hafnium, zirconium, molybdenum, tungsten, and stainless steel, more preferably, titanium. When titanium is used as the metal substrate layer, the processing thereof is moderately easy, and the strength thereof itself is high, so that it is possible to suppress a phenomenon in which an electrode is destroyed by physical impact. Furthermore, for the fact that a titanium component is to be included in the coating layer to be described later, when titanium is used as the metal substrate layer, the difference in thermal expansion coefficients between the substrate layer and the coating layer may be minimized to suppress the problem of delamination during firing.

The form of the metal substrate layer is not particularly limited, but a form in which the surface area of a coating layer formed at least one surface of the substrate layer may be maximized is preferred. For example, a metal substrate in the form of a rod, sheet, or a plate may be applied to the present technology, and in order to maximize the surface area, a metal substrate in the form of an expanded metal or mesh may be used. Meanwhile, the thickness, width, or the like of the metal substrate layer may vary depending on a specific environment in which the electrode for electrolysis provided by the present disclosure is used, and those skilled in the art may appropriately change the thickness, area, and the like of a metal substrate layer according to a desired use or required conditions.

Coating Layer

In the electrode for electrolysis provided by the present disclosure, a coating layer provides electrical activity, and thus, serves to function as a catalyst of an electrolysis reaction. Particularly, the coating layer in the present disclosure has a structure in which a total of N layers of a first coating layer to an N-th coating layer are sequentially stacked, wherein tin and titanium contents in each layer satisfy specific conditions to exhibit excellent durability and current efficiency.

As described above, when a tin component is included in a coating layer, current efficiency and performance are improved, but the tin component has a relatively low heat transfer coefficient, and thus, may cause delamination of the coating layer, or cracks in the coating layer during a firing process. Particularly, such a phenomenon largely occurs in a region in which a metal substrate layer and a coating layer are in contact, so that it is important to minimize the difference between the heat transfer coefficients of coating layer components and the heat transfer coefficient of the metal substrate layer in the region in which the metal substrate layer and the coating layer are in contact. Meanwhile, in a region in the coating layer, which is relatively far from the metal substrate layer, even if the difference in heat transfer coefficients between the metal substrate layer and the coating layer is large, it is relatively irrelevant, and it is important that the difference in heat transfer coefficients with other regions in an adjacent coating layer is small, rather than with the metal substrate layer. Therefore, instead of a single layer in which the content of each component is uniformly distributed, when a stacking structure in which the content of each component may be set different for each layer is applied as a coating layer, the difference in heat transfer coefficients between the coating layer and a metal substrate layer as well as the difference in heat transfer coefficients between one coating layer and another coating layer adjacent to the coating layer may be maintained small.

Specifically, the electrode for electrolysis provided by the present disclosure is characterized by including a first coating layer to an N-th coating layer, wherein the first coating layer is formed on at least one surface of a metal substrate layer, and the first coating layer to the N coating layer are formed sequentially stacked, and Equations 1 and 2 below are satisfied:

$$CS_{n-1}<CS_n \quad \text{[Equation 1]}$$

$$CT_{n-1}>CT_n \quad \text{[Equation 2]}$$

In the Equations, $CS_n$ is the Sn content (mol %) in an n-th coating layer, $CT_n$ is the Ti content (mol %) in an n-th coating layer, n is an integer of 2 to N, and N is an integer of 2 or greater.

Equation 1 above represents the relationship of tin contents in the first coating layer to the N-th coating layer in an equation, and Equation 2 above represents the relationship of titanium contents in the first coating layer to the N-th coating layer in an equation. Specifically, Equation 1 above means that the content of tin in a first coating layer formed on at least one surface of a metal base layer is lowest, and that the content of tin in a plurality of coating layers sequentially stacked on the first coating layer increases as the distance from the metal substrate layer increases. On the contrary, Equation 2 above means that the content of titanium in a first coating layer formed on at least one surface of a metal base layer is highest, and that the content of titanium in a plurality of coating layers sequentially stacked on the first coating layer decreases as the distance from the metal substrate layer increases.

The reason for ensuring that the content of tin for each coating layer satisfies Equation 1 above is to suppress delamination between a metal substrate layer and a coating layer by preventing a sharp change in the heat transfer coefficient between the metal substrate layer and a first coating layer, thereby preventing a sharp change in the heat transfer coefficient between coating layers. Furthermore, when the content of tin for each layer satisfies Equation 1 above, the content of tin is allowed to be highest in an N-th coating layer, which is formed on the outermost side, through which it is possible to maximize the effect of improving performance and current efficiency by a tin component in the N-th coating layer region in which an electrolysis reaction is performed by direct contact with brine and the like.

The reason for ensuring that the content of titanium for each coating layer satisfies Equation 2 above is also to suppress the above-described delamination problem. Titanium is a component exhibiting a thermal expansion coefficient similar to those of metals used as materials for a metal substrate layer, and by allowing the content of titanium in a first coating layer to be highest, the thermal expansion coefficient of the first coating layer and the thermal expansion coefficient of the metal substrate layer may be allowed to be similar. In addition, by decreasing the content of titanium as the content of tin increases in a coating layer, the difference in thermal expansion coefficients between coating layers may be maintained small, and additionally, an effect of reducing overvoltage by a titanium component may be achieved.

Meanwhile, in the electrode for electrolysis provided by the present disclosure, tin and titanium included in each coating layer may be present in the form of an oxide. For example, tin may be present in the form of a tin dioxide ($SnO_2$), and titanium may be present in the form of a titanium dioxide ($TiO_2$). In addition, in Equations 1 and 2 above, $CS_n$ and $CT_n$ are contents of metal elements of tin and titanium in a coating layer based on the number of moles of metals included in the coating layer. Meanwhile, the $CS_n$ and the $CT_n$ may be confirmed through quantitative analysis of the surface of a coating layer through Energy Dispersive X-ray Spectroscopy (EDS).

Meanwhile, more specifically, Equations 1 and 2 above may respectively be Equation 1-2 and Equation 2-2 below:

$$1<CS_n/CS_{n-1}\leq 2 \quad \text{[Equation 1-2]}$$

$$0.5\leq CT_n/CT_{n-1}<1 \quad \text{[Equation 2-2]}$$

In relation to an increase in the content of a tin component toward an outer coating layer, Equation 1-2 above indicates that the content of a tin component of a corresponding coating layer is at most two times the content of a tin component of a previous coating layer. In addition, in relation to a decrease in the content of a titanium component toward an outer coating layer, Equation 2-2 above indicates that the content of a titanium component of a corresponding coating layer is at least ½ times the content of a titanium component of a previous coating layer. This means that, when changing the content of tin and the content of titanium in a plurality of coating layers, the degree to which the contents are changed is not sharp, and if the content of tin and the content of titanium are changed more rapidly than this, a delamination phenomenon due to the difference in thermal expansion coefficients between coating layers may be induced.

In an embodiment of the present technology, a coating layer of the electrode for electrolysis may further satisfy Equation 3 below:

$$CS_{n-1}+CT_{n-1}=CS_n+CT_n \quad \text{[Equation 3]}$$

In the Equations, n is an integer of 2 to N, and

N is an integer of 2 or greater.

Equation 3 above indicates that, with respect to a total of N coating layers of a first coating layer to an N-th coating layer, the sum of the content of tin and the content of titanium in a coating layer is constant. More specifically, Equation 3 above indicates that the amount of tin increases as much as the amount of titanium decreasing in a coating layer as coating layers are stacked by one layer. By controlling the contents of tin and titanium in the first coating layer to the N-th coating layer as described above, the contents of other components in a coating layer, for example, the contents of platinum group metal components such as ruthenium, iridium, and platinum to be described later may be allowed to be constant in each coating layer, through which uniform electrode performance may be achieved.

In an embodiment of the present technology, $CS_1+CT_1$ may be 30 mol % or greater, preferably 40 mol % or greater, and may be 60 mol % or less, preferably 50 mol % or less. When the sum of the content of tin and the content of titanium in a coating layer is in the above-described range, other platinum group metals having activity may be sufficiently included in the coating layer, while the contents of tin and titanium are also sufficient therein, so that it is possible to maintain durability and performance at an excellent level.

In an embodiment of the present technology, $CS_1$, which is the content of tin in the first coating layer, may be 0 mol % to 10 mol %, and $CT_1$, which is the content of titanium in the first coating layer, may be 20 mol % to 50 mol %. In addition, $CS_N$, which is the content of tin in the N-th coating layer present on the outermost side, may be 25 mol % to 45 mol %, and $CT_N$, which is the content of titanium in the N-th coating layer, may be 5 mol % to 15 mol %. In addition, in an embodiment of the present technology, N, which corresponds to the total number of coating layers, may be an integer of 2 or greater, preferably an integer of 4 or greater. In addition, the N may be an integer of 20 or less, preferably an integer of 10 or less, more preferably an integer of 8 or less. When the number of coating layers and the content of each component in the first coating layer and in the N-th coating layer are in the above-described ranges, it is possible to easily manufacture an electrode while suppressing the delamination problem during firing, and to implement sufficient performance of the electrode. Meanwhile, when there are too many coating layers, the performance improvement is not significant compared to efforts involved in manufacturing an electrode, and when the content of each component in a coating layer is out of the above-described range, there may be problems in that delamination occurs during firing, or electrode performance is relatively poor.

In the electrode for electrolysis provided by the present disclosure, the first coating layer to the N-th coating layer may include one or more platinum group metals selected from the group consisting of ruthenium, rhodium, palladium, osmium, iridium, and platinum, and more specifically, may include the ruthenium, the iridium, and the platinum. By including the above-described platinum group metal in a coating layer, in addition to tin and titanium described above, it is possible to implement catalytic activity for an electrolysis reaction. Particularly, when ruthenium, iridium, and platinum are combined and applied as a platinum group metal in a coating layer, it is possible to lower overvoltage to improve electrode performance, and also suppress particle decomposition or corrosion during an electrolysis process to maintain excellent electrode performance for a long time due to a small change in electrode performance over time.

Furthermore, when ruthenium, iridium, and platinum are combined and applied as a platinum group metal in a coating layer, the content of iridium in the coating layer may be 45 moles to 75 moles based on 100 moles of ruthenium, and the content of platinum therein may be 15 moles to 35 moles based on 100 moles of ruthenium. When the contents between ruthenium, iridium, and platinum are adjusted in the above-described ranges, both electrode performance and durability may be excellent, and the stability of a coating layer may also be improved. Meanwhile, the platinum group metal may be present in the form of an oxide in a coating layer or may be present in the form of a dioxide or a tetraoxide.

Unlike the content of a tin component and the content of a titanium component described above which are different for each coating layer, the content of a platinum group metal in the first coating layer to the N-th coating layer may be constant. By allowing the content of a platinum group metal to be constant for each layer, it is possible to minimize the difference in electrolysis performance between layers, and accordingly, it is possible to induce a uniform electrolysis reaction in the entire region of a coating layer.

In the electrode for electrolysis provided by the present disclosure, the total content of ruthenium in the first coating layer to the N-th coating layer may be 7 $g/m^2$ or greater, preferably 20 $g/m^2$ or greater. In order to secure sufficient catalytic activity, it is preferable that the content of ruthenium in a coating layer satisfies the above-described range, and when ruthenium is included less than the above-described range, an electrolysis reaction may not be smoothly performed.

The electrode for electrolysis provided by the present disclosure may specifically be an anode. In addition, the electrode for electrolysis provided by the present disclosure may be used for an anode reaction of the electrolysis of an aqueous solution containing chloride, and the aqueous solution containing chloride may be an aqueous solution containing sodium chloride or potassium chloride.

The electrode for electrolysis provided by the present technology may be used as an electrode for manufacturing hypochlorite or chlorine, and may be, for example, used as an anode for electrolysis of brine to produce hypochlorite or chlorine.

Method for Manufacturing Electrode for Electrolysis

The present disclosure provides a method for manufacturing an electrode for electrolysis, the method characterized by including applying and firing a first coating composition on at least one surface of a metal substrate to form a first coating layer, and sequentially applying and firing a second coating composition to an N-th coating composition on the formed first coating layer to form a second coating layer to an N-th coating layer, wherein Equations 4 and 5 below are satisfied:

$$CS'_{n-1} < CS'_n \quad \text{[Equation 4]}$$

$$CT'_{n-1} > CT'_n \quad \text{[Equation 5]}$$

In the Equations, $CS'_n$ is the Sn content (mol %) in an n-th coating composition, $CT'_n$ is the Ti content (mol %) in an n-th coating composition, n is an integer of 2 to N, and N is an integer of 2 or greater.

In the method for manufacturing an electrode for electrolysis of the present technology, the metal substrate may be the same as the metal substrate layer of the electrode for electrolysis described above.

In the method for manufacturing an electrode for electrolysis of the present technology, the first coating composition to the N-th coating composition include tin and titanium, and the contents of tin and titanium in the compositions may satisfy Equations 4 and 5 above. The electrode for electrolysis of the present technology is manufactured by forming a first coating layer on at least one surface of a metal substrate layer, and then sequentially forming a second coating layer to an N-th coating layer, and as described in the section for the electrode for electrolysis, in order to allow the content of tin to increase and the content of titanium to decrease as the distance from the metal substrate layer increases, the content of a coating composition used in the formation of a coating layer is also required to satisfy Equations 4 and 5.

Meanwhile, tin and titanium included in the coating composition may be included in the form of a precursor which may be easily converted into the form of an oxide during a firing process. Specifically, in the case of tin, a halide, a nitric oxide, a sulfur oxide, and the like of tin may be used as a tin precursor compound, and specifically, one or more selected from the group consisting of tin chloride ($SnCl_2$), tin nitrate ($Sn(NO_3)_2$), and tin sulfate ($SnSO_4$) may be used as a tin precursor compound. In addition, in the case of titanium, a titanium alkoxide compound, for example, titanium isopropoxide ($Ti[OCH(CH_3)_2]_4$) and/or titanium butoxide ($Ti(OCH_2CH_2CH_2CH_3)_4$) may be used as a titanium precursor compound. When the above-described precursor is dissolved in a coating composition and used, the precursor may be oxidized at a high yield during a firing process.

In the method for manufacturing an electrode for electrolysis of the present technology, the first coating composition to the N-th coating composition may further include one or more platinum group metals selected from the group consisting of ruthenium, rhodium, palladium, osmium, iridium, and platinum.

As described above with respect to the electrode for electrolysis, a platinum group metal may be included in a coating layer to exhibit catalytic activity, and accordingly, a platinum group metal may also be included in a coating composition. As in the case of tin and titanium, the platinum group metal may be included in a coating composition in the form of a precursor.

In the case of ruthenium, a hydrate, a hydroxide, a halide, or an oxide of ruthenium may be used as a ruthenium precursor compound, and specifically, one or more selected from the group consisting of ruthenium hexafluoride ($RuF_6$), ruthenium (III) chloride ($RuCl_3$), ruthenium (III) chloride hydrate ($RuCl_3 \cdot xH_2O$), ruthenium (III) bromide ($RuBr_3$), ruthenium (III) bromide hydrate ($RuBr_3 \cdot xH_2O$), ruthenium iodide ($RuI_3$), and an acetic acid ruthenium salt may be used as a ruthenium precursor compound.

In the case of iridium, a hydrate, a hydroxide, a halide, or an oxide of iridium may be used as an iridium precursor compound, and specifically, one or more selected from the group consisting of iridium chloride ($IrCl_3$), iridium chloride hydrate ($IrCl_3 \cdot xH_2O$), potassium hexachloroiridate ($K_2IrCl_6$), potassium hexachloroiridate hydrate ($K_2IrCl_6 \cdot xH_2O$) may be used as an iridium precursor compound.

In the case of platinum, a hydrate, a hydroxide, a halide, or an oxide of platinum may be used as a platinum precursor compound, and specifically, one or more selected from the group consisting of chloroplatinic acid hexahydrate ($H_2PtCl_6 \cdot 6H_2O$), diamine dinitro platinum ($Pt(NH_3)_2(NO)_2$), platinum (IV) chloride ($PtCl_4$), platinum (II) chloride ($PtCl_2$), potassium tetrachloroplatinate ($K_2PtCl_4$), and potassium hexachloroplatinate ($K_2PtCl_6$), platinum acetylacetonate ($C_{10}H_{14}O_4Pt$), and ammonium hexachloroplatinate ($[NH_4]_2PtCl_6$) may be used as a platinum precursor compound.

When any of above-listed ruthenium, iridium, and platinum precursor compounds is used, an oxide of a platinum group metal may be easily formed in a firing step.

In the method for manufacturing an electrode for electrolysis of the present technology, as a solvent of a coating composition, an alcohol-based solvent may be used. When an alcohol-based solvent is used, the above-described components may be easily dissolved, and the coupling force between the components may be maintained even in a step of forming a coating layer after the applying of a coating composition. Preferably, one or more selected from the group consisting of butanol, isopropyl alcohol, and butoxyethanol may be used as the solvent. When an alcohol of the above-described types is used as the solvent of a coating composition, coating may be performed more uniformly.

In the method for manufacturing an electrode for electrolysis of the present technology, a step of pre-treating a metal substrate may be performed before forming the coating layer.

The pre-treatment may be performing chemical etching, blasting or thermal spraying on a metal substrate to form irregularities on the surface of the metal substrate.

The pre-treatment may be performed by sand blasting the surface of a metal substrate to form fine irregularities, followed by treating the same with a salt or an acid. For example, the pre-treatment may be performed by forming irregularities on the surface of a metal substrate by sand blasting the surface with alumina, immersing the substrate in a sulfuric acid aqueous solution, and then washing and drying the substrate to form fine irregularities on the surface of the metal substrate.

In the method for manufacturing an electrode for electrolysis of the present technology, the applying of a coating composition may be performed by any method known in the art without particular limitation as long as the coating composition may be evenly applied on a metal substrate.

The applying may be performed by any one method selected from the group consisting of doctor blade, die casting, comma coating, screen printing, spray spraying, electrospinning, roll coating, and brushing.

In the method for manufacturing an electrode for electrolysis of the present technology, firing, which is performed after the applying of a coating composition, may be performed for 1 hour or less at 400° C. to 600° C., and it is preferable that the firing is performed for 5 minutes to 30 minutes at 450° C. to 550° C.

When firing is performed under the above-described conditions, impurities in a catalyst layer may be easily removed while not affecting the strength of a metal substrate.

In the method for manufacturing an electrode for electrolysis of the present technology, a drying step may be further included after the applying of a coating composition and before the firing.

The drying may be performed for 5 minutes to 60 minutes at 50° C. to 300° C., and it is preferable that the drying is performed for 5 minutes to 20 minutes at 50° C. to 200° C.

When the above conditions are satisfied, energy consumption may be minimized while sufficiently removing a solvent.

Meanwhile, in the method for manufacturing an electrode for electrolysis of the present technology, the formation of each coating layer of the first coating layer to the N-th coating layer may be performed by sequentially repeating the applying and the firing such that ruthenium is 7 g or greater based on the total ruthenium per unit area ($m^2$) of a metal substrate. That is, a manufacturing method according to another embodiment of the present technology may be performed by applying, drying, and firing the coating composition on at least one surface of a metal substrate to form a coating layer, and then repeating applying, drying, and firing the same coating composition on one surface of the formed coating layer. Meanwhile, the first coating layer to the N-th coating layer in the present technology are distinguished based on tin and titanium contents, so that a coating layer formed by forming a first coating layer, and then applying a first coating composition on one surface of the first coating layer, followed by drying and firing also corresponds to a first coating layer in the same way as the first coating layer formed above.

Hereinafter, the present invention will be described in more detail with reference to embodiments and experimental embodiments, but the present invention is not limited by the embodiments and experimental embodiments. The embodiments according to the present invention may be modified into other various forms, and the scope of the present invention should not be construed as being limited to the embodiments described below. The embodiments of the present invention are provided to describe the present invention more fully to those skilled in the art.

Materials

In the present embodiment, an expanded metal-type titanium substrate (Grade 1, thickness 1 mm) manufactured by Baoji Corporation was used as a metal substrate, and $RuCl_3 \cdot 3H_2O$ was used as a ruthenium precursor compound, $H_2PtCl_6 \cdot 6H_2O$ was used as a platinum precursor compound, $IrCl_3 \cdot 3H_2O$ was used as an iridium precursor compound, $SnCl_2 \cdot 2H_2O$ was used as a tin precursor compound, and $Ti[OCH(CH_3)_2]$ was used as a titanium precursor compound. Also, butanol was used as a solvent for a coating composition.

Pretreatment of Metal Substrate

Before forming a coating layer on the metal substrate, the surface of the substrate was sand-blasted with an aluminum oxide (white alumina, F120) under the condition of 0.4 MPa, and then the substrate was put into a 10 wt % oxalic acid aqueous solution heated to 90° C. and treated for 2 hours, and then washed with distilled water to complete pretreatment.

Example 1

Ru:Ir:Pt:Ti:Sn=27:20:8:45−*x*:*x*

The proportional expression above represents the molar ratio among metal components in a coating composition, and in the proportional expression, the value of x was respectively set to 0, 4, 8, 12, 16, and 20 to prepare 6 types of coating compositions in which the molar ratio of each component has been adjusted, and then the 6 types of coating compositions were applied, dried, and fired on a metal substrate layer in the order of a coating composition with the smallest tin content to a coating composition with the largest tin content. After each coating layer was formed, firing was performed for 10 minutes at 480° C., and after a six-layered coating layer was formed, final firing was performed for 1 hour at 560° C. to manufacture an electrode for electrolysis.

Example 2

An electrode for electrolysis was manufactured in the same manner as the above, except that in Example 1, the value of x was respectively set to 0 and 20 to prepare 2 types of coating compositions, and a two-layered coating layer was formed.

Comparative Example 1

A coating composition was prepared by setting the molar ratio among ruthenium, iridium, platinum, titanium, and tin to 27:20:8:20:25, and the coating composition was applied, dried, and fired on the pre-treated metal substrate layer to form a coating layer. The applying, drying, and firing were repeated 6 times, and after each coating layer was formed, firing was performed for 10 minutes at 480° C. Thereafter, after all the coating layers were formed, final firing was performed for 1 hour at 560° C. to manufacture an electrode for electrolysis.

Experimental Example 1. Performance Evaluation of Electrode for Electrolysis Using Linear Sweep Voltammetry The electrode for electrolysis manufactured in each of Examples 1 and 2, and Comparative Example 1 was used as an anode, and a Pt counter electrode and an SCE reference electrode were connected thereto to form an electrolytic cell, and thereafter, the evaluation was performed in a 25% NaCl solution in the range of 1 V to 2 V by linear sweep voltammetry (LSV). The results are shown in FIG. 1.

Referring to FIG. 1, at a current density of 0.4 A/cm$^2$, the electrode for electrolysis manufactured in Example 1 exhibited a potential of 0.826 V, and the electrode for electrolysis manufactured in Example 2 exhibited a potential of 1.844 V, whereas the electrode for electrolysis manufactured in Comparative Example 1 exhibited a potential of 1.924 V under the same current density condition.

This means that the electrodes of Examples had a lower overvoltage than that of Comparative Example, and that the electrodes of Examples have excellent performance compared to the electrode of Comparative Example.

Experimental Example 2. Test of Degree of Delamination of Electrode

On the surface of the electrode for electrolysis manufactured in each of Examples 1 and 2, and Comparative Example 1, a transparent tape was attached, and then detached to check the degree of smearing, thereby confirming the degree of delamination of the electrode. The results of Example 1 are shown in FIG. 2, the results of Example 2 are shown in FIG. 3, and the results of Comparative Example 1 are shown in FIG. 4.

Figure 2:
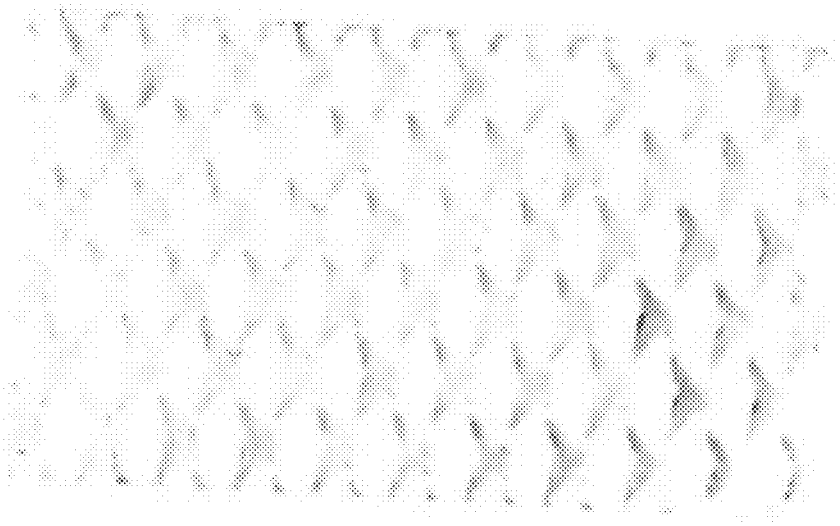
FIG. 2 is a view showing results of the test of degree of delamination of an electrode for electrolysis manufactured in Example 1 of the present disclosure.
Figure 3:
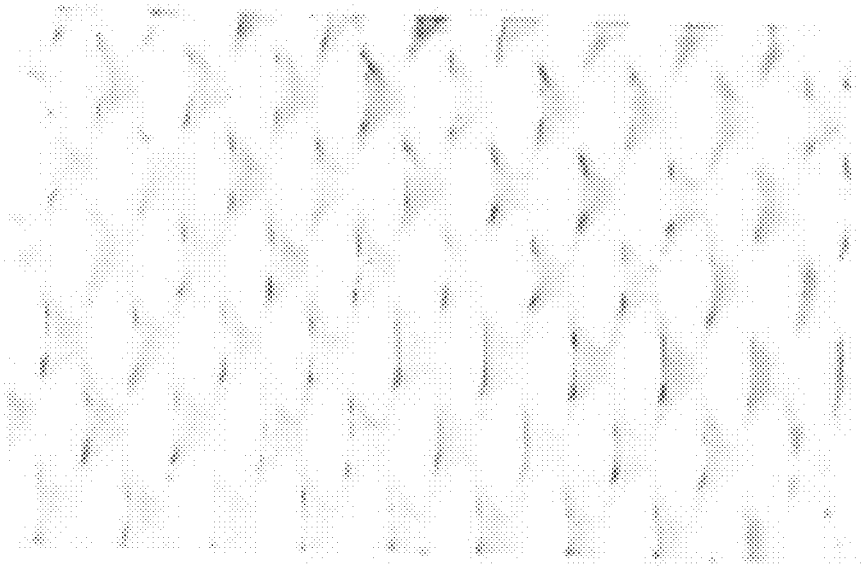
FIG. 3 is a view showing results of the test of degree of delamination of an electrode for electrolysis manufactured in Example 2 of the present disclosure.
Figure 4:
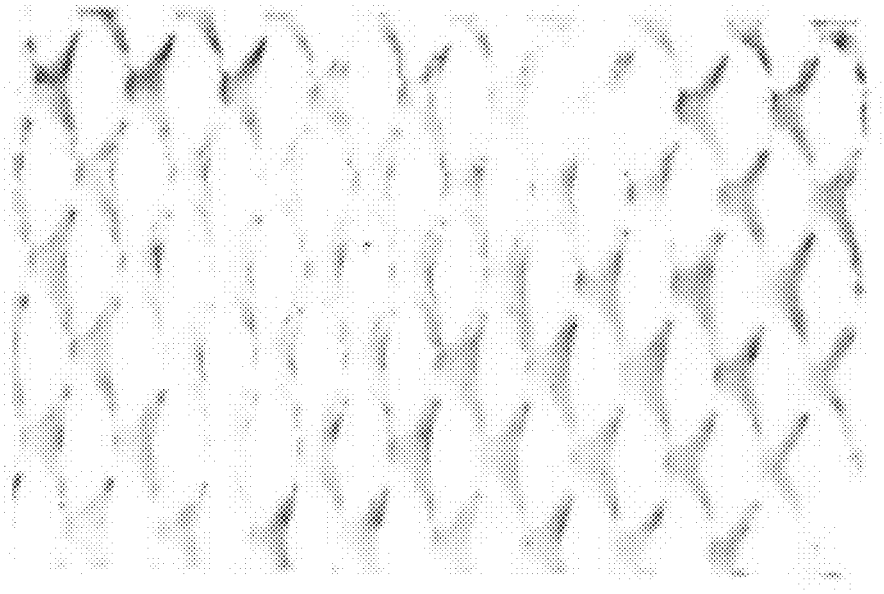
FIG. 4 is a view showing results of the test of degree of delamination of an electrode for electrolysis manufactured in Comparative Example 1 of the present disclosure.

As it can be seen in FIG. 2 to FIG. 4, the degree of smearing of Comparative Example 1 was greater than those of Examples 1 and 2, which means that the amount of the coating layer de-laminated by being attached to the transparent tape was larger in Comparative Example 1, and that the electrode durability of Examples is excellent compared to that of Comparative Example.

The invention claimed is:

1. An electrode for electrolysis comprising:

a metal substrate layer; and a first coating layer to an N-th coating layer, wherein the first coating layer is formed on at least one surface of the metal substrate layer, and the first coating layer to the N-th coating layer are formed sequentially stacked, and Equations 1 and 2 below are satisfied:

$$CS_{n-1}<CS_n \quad \text{[Equation 1]}$$

$$CT_{n-1}<CT_n \quad \text{[Equation 2]}$$

wherein in the Equations, $CS_n$ is a Sn content (mol %) in an n-th coating layer, $CT_n$ is a Ti content (mol %) in an n-th coating layer, n is an integer of 2 to N, and N is an integer of 4 or greater.

2. The electrode of claim 1, wherein Equation 3 below is further satisfied:

$$CS_{n-1}+CT_{n-1}=CS_n+CT_n \quad \text{[Equation 3]}$$

wherein in the Equations, n is an integer of 2 to N, and

N is an integer of 4 or greater.

3. The electrode of claim 1, wherein the Equation 1 above is Equation 1-2 below:

$$1<CS_n/CS_{n-1}\leq 2. \quad \text{[Equation 1-2]}$$

4. The electrode of claim 1, wherein the Equation 2 above is Equation 2-2 below:

$$0.5\leq CT_n/CT_{n-1}<1. \quad \text{[Equation 2-2]}$$

5. The electrode of claim 1, wherein $CS_1+CT_1$ is 30 mol % to 60 mol %.

6. The electrode of claim 1, wherein the first coating layer to the N-th coating layer comprise one or more platinum group metals selected from the group consisting of ruthenium, rhodium, palladium, osmium, iridium, and platinum.

7. The electrode of claim 6, wherein a content of the platinum group metal in the first coating layer to the N-th coating layer is constant.

8. The electrode of claim 6, wherein the first coating layer to the N-th coating layer comprise ruthenium, iridium, and platinum.

9. The electrode of claim 8, wherein a total content of the ruthenium in the first coating layer to the N-th coating layer is 20 g/m$^2$ or greater.

10. The electrode of claim 1, wherein the N is an integer of 4 to 10.

11. The electrode of claim 1, wherein the metal substrate layer comprises one or more of nickel, titanium, tantalum, aluminum, hafnium, zirconium, molybdenum, tungsten, or stainless steel.

12. A method for manufacturing an electrode for electrolysis, the method comprising:

applying and firing a first coating composition on at least one surface of a metal substrate to form a first coating layer; and sequentially applying and firing a second coating composition to an N-th coating composition on the formed first coating layer to form a second coating layer to an N-th coating layer, wherein Equations 4 and 5 below are satisfied:

$$CS'_{n-1}<CS'_n \quad \text{[Equation 4]}$$

$$CT'_{n-1}>CT'_n \quad \text{[Equation 5]}$$

wherein in the Equations, $CS'_n$ is a Sn content (mol %) in an n-th coating composition, $CT'_n$ is a Ti content (mol %) in an n-th coating composition, n is an integer of 2 to N, and N is an integer of 4 or greater.

13. The method of claim 12, wherein the first coating composition to the N-th coating composition comprise one or more platinum group metals selected from the group consisting of ruthenium, rhodium, palladium, osmium, iridium, and platinum.

14. The method of claim 12, wherein the firing is performed for 1 hour or less at a temperature of 400° C. to 600° C.

15. The method of claim 12, wherein a solvent of the first coating composition to the N-th coating composition comprises one or more g of butanol, isopropyl alcohol, or butoxyethanol.

* * * * *